US006984180B2

(12) United States Patent
Hasebe

(10) Patent No.: US 6,984,180 B2
(45) Date of Patent: Jan. 10, 2006

(54) GOLF CLUB HEAD AND GOLF CLUB SET

(75) Inventor: Yu Hasebe, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 10/386,451

(22) Filed: Mar. 13, 2003

(65) Prior Publication Data

US 2003/0176231 A1 Sep. 18, 2003

(30) Foreign Application Priority Data

Mar. 14, 2002 (JP) ..... P2002-070477

(51) Int. Cl.
*A63B 53/04* (2006.01)

(52) U.S. Cl. ..... 473/291; 473/346; 473/350

(58) Field of Classification Search ..... 473/345, 473/346, 350, 290, 291
See application file for complete search history.

(56) References Cited

U.S. PATENT DOCUMENTS

| | | | | | |
|---|---|---|---|---|---|
| 4,432,549 | A | * | 2/1984 | Zebelean | 473/346 |
| 4,824,110 | A | * | 4/1989 | Kobayashi | 473/332 |
| 4,840,380 | A | * | 6/1989 | Kajita et al. | 473/291 |
| 5,351,958 | A | | 10/1994 | Helmstetter | |
| 5,588,923 | A | | 12/1996 | Schmidt et al. | |
| 5,711,722 | A | * | 1/1998 | Miyajima et al. | 473/346 |
| 5,766,092 | A | * | 6/1998 | Mimeur et al. | 473/329 |
| 5,807,191 | A | * | 9/1998 | Nakahara | 473/350 |
| 5,971,868 | A | * | 10/1999 | Kosmatka | 473/349 |
| 5,984,803 | A | | 11/1999 | Chappell | |
| 6,045,456 | A | * | 4/2000 | Best et al. | 473/291 |
| 6,086,485 | A | * | 7/2000 | Hamada et al. | 473/329 |
| 6,093,112 | A | | 7/2000 | Peters et al. | |
| 6,200,228 | B1 | * | 3/2001 | Takeda | 473/324 |
| 6,210,290 | B1 | * | 4/2001 | Erickson et al. | 473/345 |
| 6,290,607 | B1 | | 9/2001 | Gilbert et al. | |
| 6,679,784 | B2 | * | 1/2004 | Mase | 473/290 |

FOREIGN PATENT DOCUMENTS

| | | | |
|---|---|---|---|
| JP | 06-319836 | A | 11/1994 |
| JP | 07-148288 | A | 6/1995 |
| JP | 7-204297 | | 8/1995 |
| JP | 8-112378 | | 5/1996 |
| JP | 08-322972 | A | 12/1996 |
| JP | 2000-288129 | | 10/2000 |
| JP | 2001-000605 | A | 1/2001 |
| JP | 2001-224714 | A | 8/2001 |

* cited by examiner

*Primary Examiner*—Stephen Blau
(74) *Attorney, Agent, or Firm*—Sughrue Mion, PLLC

(57) ABSTRACT

A golf club head is formed by integrally welding a face portion and a back portion with each other. The face portion has a circumferential edge portion in its back surface. The circumferential edge portion is made of a flat surface all over its circumference. In the rear surface of the face portion, the part other than the circumferential edge portion is formed as a recess portion. In the bottom surface of the recess portion, a first bottom surface which is the deepest, a second bottom surface which is the second deepest, a third bottom surface which is the third deepest, and a fourth bottom surface which is the shallowest are formed in descending order. Three ribs are provided vertically to extend through the recess portion.

20 Claims, 6 Drawing Sheets

GOLF CLUB HEAD AND GOLF CLUB SET

The present disclosure relates to the subject matter contained in Japanese Patent Application No. 2002-70477 filed on Mar. 14, 2002, which is incorporated herein by reference in its entirety.

BACKGROUND OF THE INVENTION

1. Field of the Invention

The present invention relates to an iron-type golf club head, and an iron golf club set made up of a plurality of golf clubs, which have such golf club heads and are different in club length. Particularly, the invention relates to a hollow golf club head, and a golf club set having such hollow golf club heads.

2. Description of the Related Art

In an iron golf club set made up of a plurality of golf clubs different in club length, the loft angle of the head is increased as the club length is shorter. In addition, in recent years, a hollow golf club head provided with a hollow portion for increasing the depth of the center of gravity to thereby expand the sweet area has been commercially available.

SUMMARY OF THE INVENTION

It is an object of the invention to provide a golf club head, which has a proper distribution of the center of gravity and is easy to hit a ball high. In addition, it is another object of the invention to provide a golf club set in which each golf club applies a proper quantity of spin to a ball in accordance with its club number and it is easy to stop a ball with a short iron while it is easy to hit a ball high with a middle iron or a long iron so as to obtain a large carry.

According to the invention, there is provided an iron-type hollow golf club head a face portion, a back portion, and a sole portion. The face portion, the back portion, and the sole portion define a hollow portion. The face portion is thicker as approaching to a lower portion thereof at least on a toe side thereof.

A golf club set according to the invention is made up of a plurality of iron-type golf clubs different in club length, each golf club having a head whose loft angle is larger as the club length of the golf club is shorter. In the golf club set, the golf club heads of the golf clubs are golf club heads according to the invention.

Since the hollow portion is provided, the golf club head according to the invention is deep in depth ZG of the center of gravity. In addition, since the face portion is made thicker in its lower portion, the height HG of the center of gravity can be reduced easily. It is therefore easy to hit a ball high, and it is easy to make a club design capable of hitting a ball high particularly with a middle iron or a long iron.

According to the invention, preferably, a plurality of step portions extending in a width direction of the face portion are provided at least on a toe side of a back surface of the face portion facing the hollow portion so that the face portion is thicker stepwise in a lower portion thereof.

When the face portion is designed to be thickened multi-stepwise, the thickness of each part of the face portion can be brought into agreement with its aimed value with high precision in producing the face portion. Incidentally, if the thickness of the face portion increased continuously toward its lower side, control of the thickness would be difficult in case of either casting or forging, so that the deviation from an aimed, designed thickness distribution would be apt to increase. According to the structure in which the face portion is thickened multi-stepwise, the thickness distribution and hence the properties such as the distribution of the center of gravity and the moment of inertia can be made to agree with their designed values with high precision.

According to the invention, a rib extending vertically may be provided near a central portion of a back surface of the face portion in a width direction of the face portion. Alternatively, a thick portion is provided near a central portion of a back surface of the face portion in a width direction of the face portion so that the thick portion is thicker than the face portion on a toe side. When such a rib or such a thick portion is provided, the feeling of hitting a ball or the sound of hitting a ball can be adjusted subtly. The feeling of hitting a ball or the sound of hitting a ball depends subtly on the rigidity of the face portion, the moment of inertia of the gold club head, and so on. The feeling of hitting a ball and the sound of hitting a ball are very important factors for upper-middle-level to professional golfers.

The invention is preferably applied to golf club heads whose loft angle is not larger than 43°, that is, whose club number is not larger than 9. Wedges whose loft angle is larger than 43° are often used for a chip shot or a bunker shot, and it is preferable to adopt dedicated designs for the wedges.

In the golf club set according to the invention, preferably, thickness of an upper portion of the face portion of each of golf club heads, thickness of an upper portion of the back portion of each of golf club heads, and a distance between an upper end of the hollow portion and an upper end of each of golf club heads are longer in a golf club whose club length is shorter. Preferably, thickness of an intersecting portion of a back portion and a sole portion of a golf club head is smaller in a golf club whose club length is shorter. With such a configuration, the larger the club number of a club is, the higher the height HG of the center of gravity of the golf club head is. Thus, it becomes easier to apply spin to a ball. Incidentally, in a short iron whose club number is large, a ball (hit ball) is hit sufficiently high by its loft in spite of its high height HG of the center of gravity. In this case, importance is attached to the quantity of ball spin rather than the ball height, and increase in the quantity of ball spin to thereby make it easy to stop the ball on the green is favorable for lowering the score of a golfer.

On the other hand, with a middle iron or a long iron, increase in the launch angle of a ball rather than the ball spin to thereby make it easy to secure a large carry is favorable for reducing the rate of missed shots.

DETAILED DESCRIPTION OF THE PREFERRED EMBODIMENTS

Figure 1:
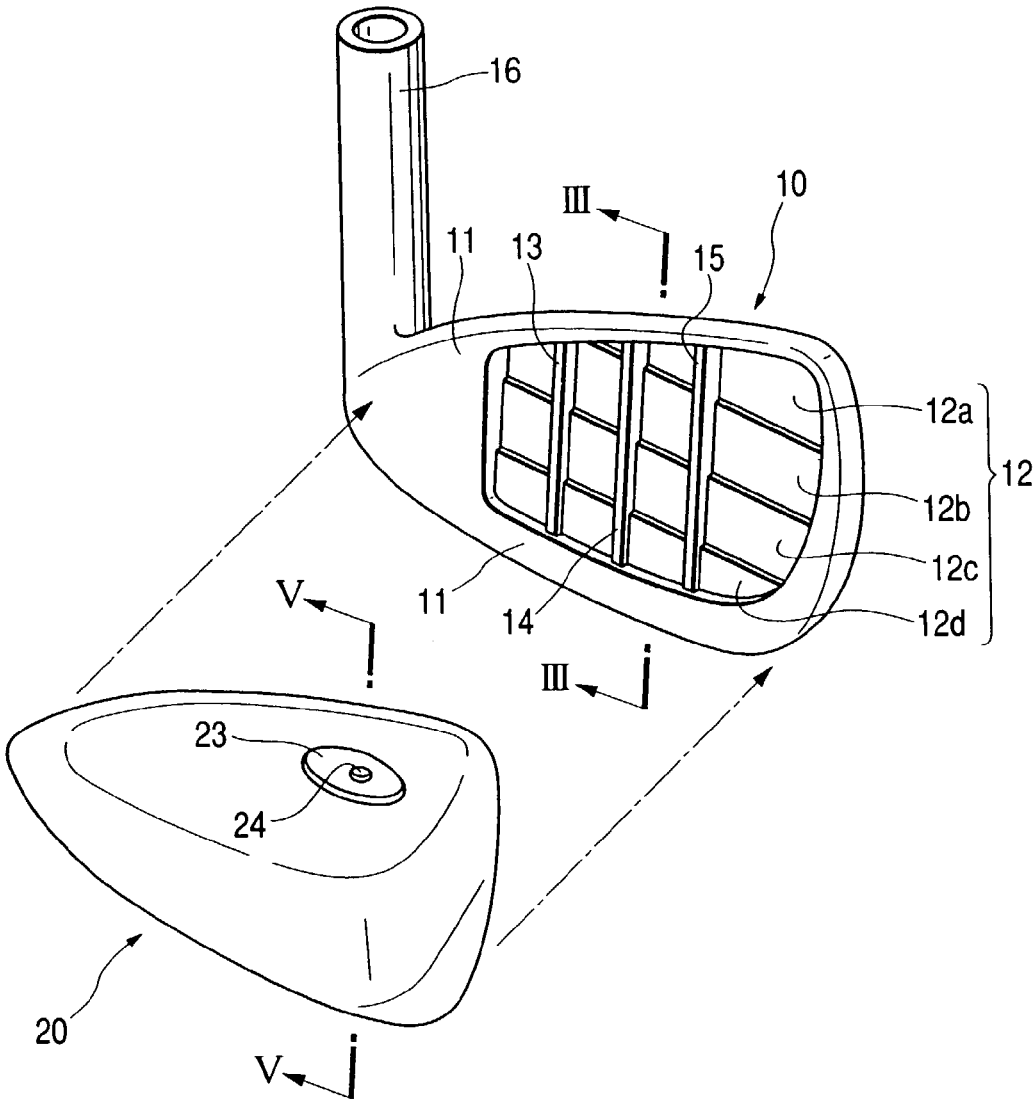
FIG. 1 is an exploded perspective view from the rear of a golf club head according to an embodiment of the invention.
Figure 2:
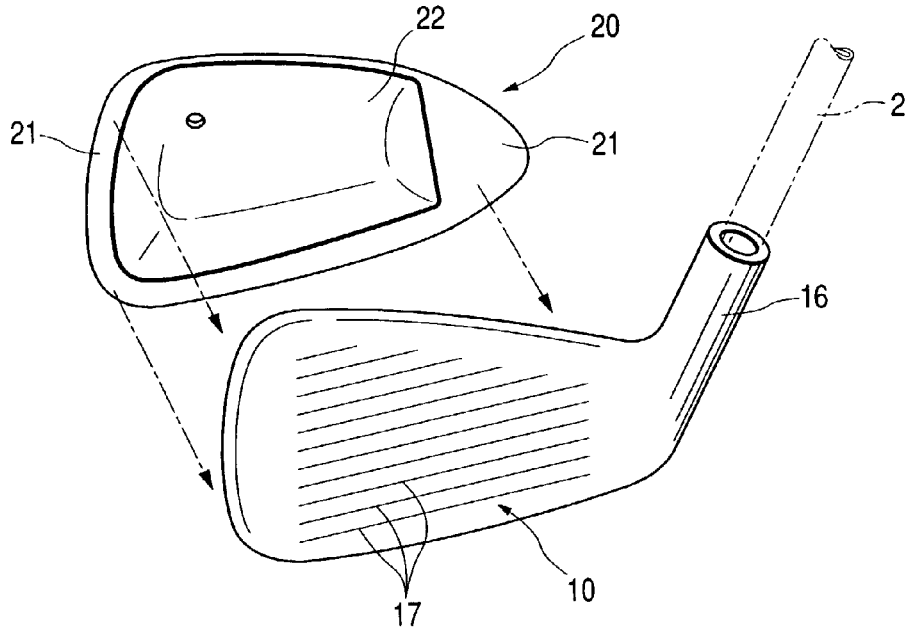
FIG. 2 is an exploded perspective view from the front of the golf club head according to the embodiment.
Figure 3:
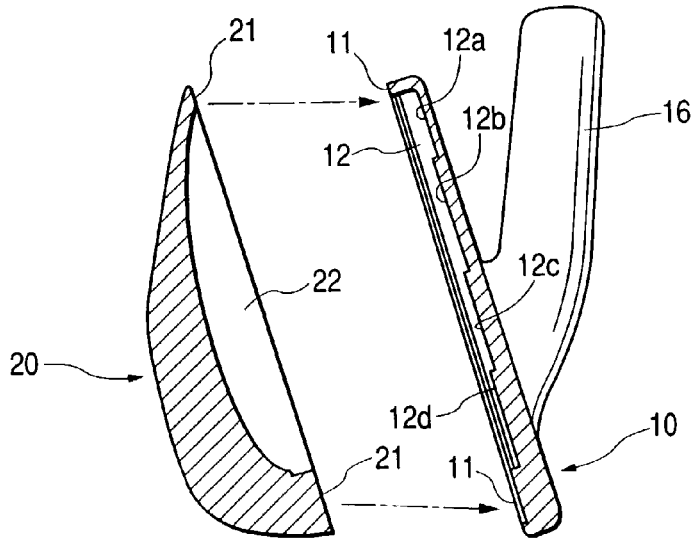
FIG. 3 is an exploded sectional view taken on line III—III in FIG. 1.
Figure 4A:
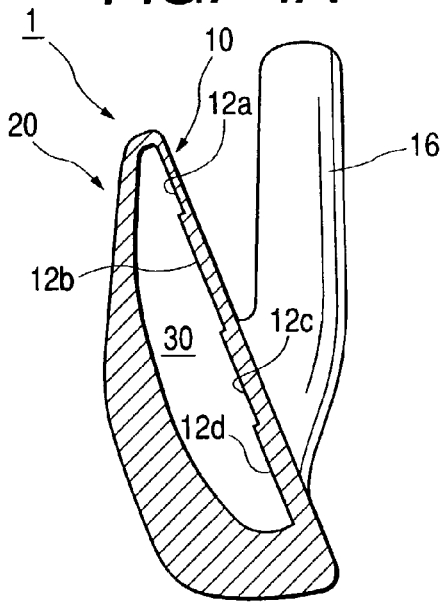
FIG. 4A is a longitudinally sectional view of the golf club head according to the embodiment.
Figure 4B:
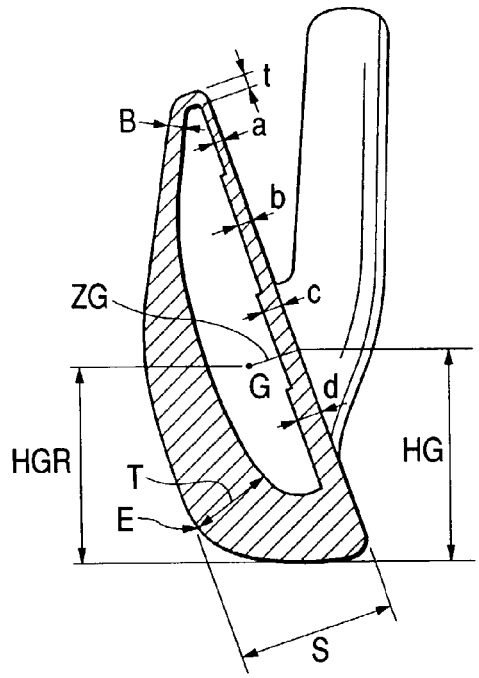
FIG. 4B is a dimensional drawing of the golf club head.
Figure 5:
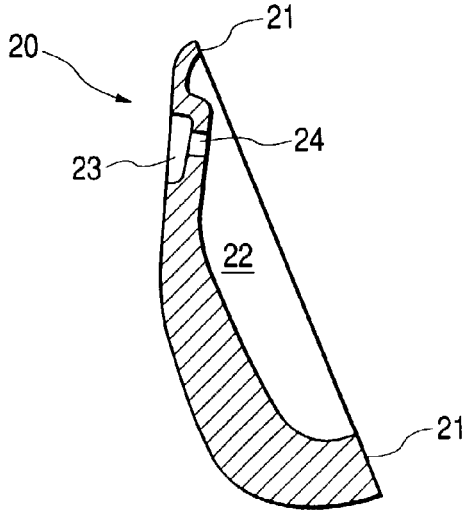
FIG. 5 is a sectional view taken on line V—V in FIG. 1, showing a back portion.
Figure 6:
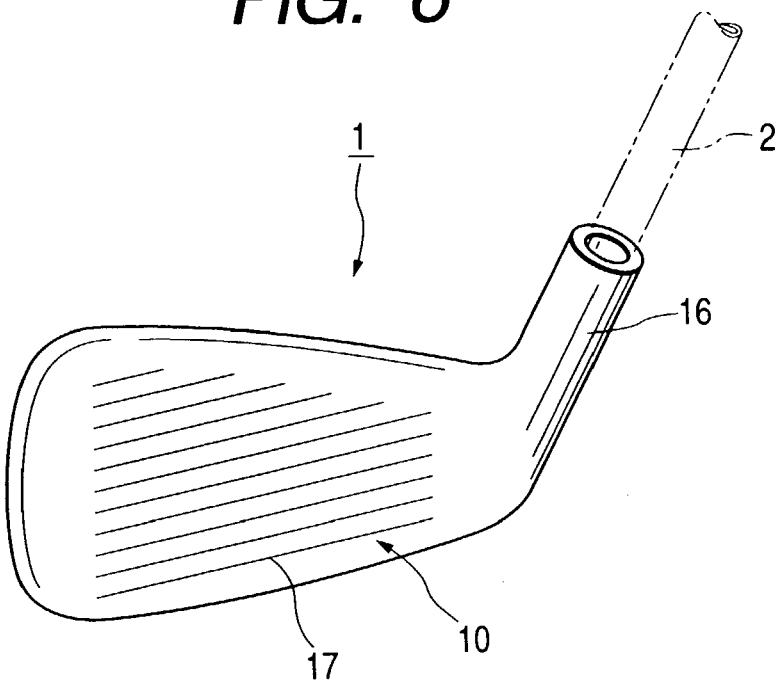
FIG. 6 is a perspective view from the front of the golf club head.
Figure 7:
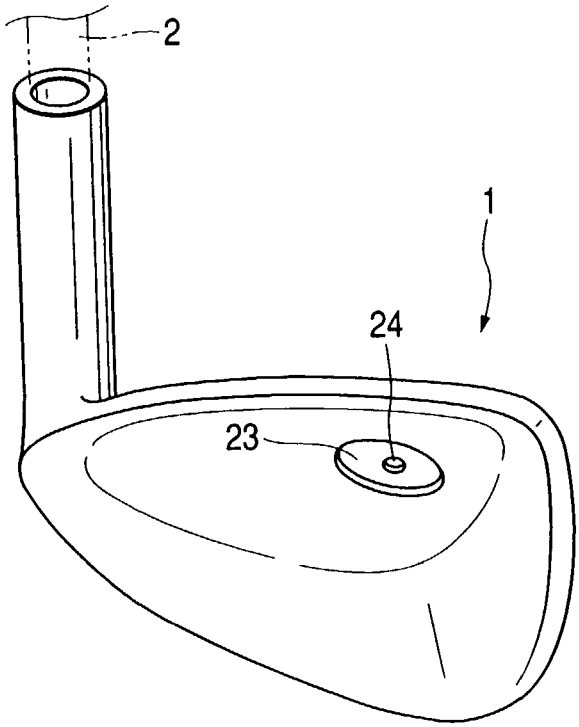
FIG. 7 is a perspective view from the rear of the golf club head.

An embodiment of the invention will be described below with reference to the drawings. FIG. 1 is an exploded perspective view from the rear of a golf club head according to an embodiment of the invention. FIG. 2 is an exploded perspective view from the front of the golf club head according to the embodiment. FIG. 3 is an exploded sectional view taken on line III—III in FIG. 1. FIG. 4A is a longitudinally sectional view of the golf club head according to the embodiment, and FIG. 4B is a dimensional drawing of the golf club head. FIG. 5 is a sectional view taken on line V—V in FIG. 1, showing a back portion. FIG. 6 is a perspective view from the front of the golf club head. FIG. 7 is a perspective view from the rear of the golf club head.

This golf club head 1 is an iron head in which a face portion 10 and a back portion 20 made of metal respectively have been welded integrally.

The face portion 10 has a circumferential edge portion 11 in its back surface. The circumferential edge portion 11 is formed of a flat surface all over its circumference. In the rear surface of the face portion 10, a part other than the circumferential edge portion 11 is formed as a recess portion 12. The face portion 10 is integrated with a hosel 16.

In the bottom surface of the recess portion 12, a first bottom surface 12*a* which is the deepest, a second bottom surface 12*b* which is the second deepest, a third bottom surface 12*c* which is the third deepest, and a fourth bottom surface 12*d* which is the shallowest are formed in descending order. The respective bottom surfaces 12*a* to 12*d* are parallel with the face surface (the front surface of the face portion 10), and the borders among the respective bottom surfaces 12*a* to 12*d* form steps. Accordingly, the recess portion 12 becomes shallower stepwise in its lower portion, and the thickness of the face portion 10 corresponding to the recess portion 12 becomes thicker stepwise in its lower portion.

Three ribs 13, 14 and 15 are provided vertically to extend through the recess portion 12. The central rib 14 is located on the rear side in the substantially central portion of the face surface in the toe-heel direction. The ribs 13 and 15 are located on both sides of the rib 14, respectively.

Incidentally, scorelines (grooves) 17 are provided in the face surface.

The back portion 20 has a circumferential edge portion 21 formed of a flat surface, and a first recess portion 22 formed as a part other than the circumferential edge portion 21. Incidentally, in this embodiment, a second recess portion 23 is provided on the toe side of the upper portion of the back surface of the back portion 20, and a small hole 24 is provided in this second recess portion 23.

In this back portion 20, the thickness on the rear side of the first recess portion 22 becomes thicker in a lower portion of the back portion.

The circumferential edge portion 21 of the back portion 20 is laid to overlap the circumferential edge portion 11 of the face portion 10, and the both are welded with each other. Thus, a golf club head 1 is formed. This golf club head 1 is a hollow head having a hollow portion 30 formed by joining the recess portion 12 and the first recess portion 22 together.

A shaft 2 is inserted into the hosel 16 of the golf club head 1 and fixedly attached thereto by a bonding agent. Thus, a golf club (iron) is formed. The loft angle of the golf club is not larger than 43°. That is, the golf club is an iron whose club number is 9 or smaller.

In the golf club having the golf club head 1, the center of gravity is deep because the golf club head 1 is a hollow head. That is, the distance ZG between the center of gravity G and the face surface is long. Thus, the sweet area is wide.

In the golf club head 1, the height HGR or HG of the center of gravity G can be designed to be low because the face portion 10 is thicker as approaching to its lower portion. Incidentally, as shown in FIG. 4B, the height HGR of the center of gravity G designates the height between a horizontal plane and the center of gravity G when the golf club is soled on the horizontal plane. The height HG designates the height between the horizontal plane and a projected point of the center of gravity G on the face surface.

It is preferable that the height HGR of the center of gravity is not larger than 17.7 mm, particularly 15.5–17.7 mm. It is preferable that the depth ZG of the center of gravity is 4.3–7 mm, particularly 4.5–6.5 mm.

When the height HG or HGR of the center of gravity is reduced, it becomes easy to hit a ball high with a middle iron or a long iron. Incidentally, such middle irons include a #5 iron, a #6 iron, and a #7 iron or include a #5 iron and a #6 iron, and such long irons include irons whose club number is #4 or lower (for example, #2–#4).

The golf club set according to the invention is, for example, formed as a set of #2–#9 irons. Incidentally, the #2 iron or the #3 iron may be excluded from the set, and occasionally, the #4 iron may be also excluded from the set.

It is preferable that the loft angle of each golf club constituting the golf club set is not larger than 43°, preferably not larger than 42°. It is preferable that the loft angle is not smaller than 18°, particularly not smaller than 20°.

According to the invention, as the club number is larger, that is, from the long irons toward the short irons, the length of the shaft is reduced so that the club length of the golf club is reduced.

According to the invention, it is preferable that the thickness of the upper portion of the face portion, for example, the thickness a of the first bottom surface 12*a*, the thickness B of the upper portion of the back portion 20, and the thickness (top thickness) t between the upper end of the hollow portion 30 and the golf club head top surface are increased as the club number is larger. When the thickness of the upper portion of the golf club head is increased as the club number is larger, the height HG of the center of gravity is increased correspondingly. Thus, back spin can be applied to a ball with a short iron easily enough to make it easy to stop the ball falling on the green.

Incidentally, the loft angle of the short iron is sufficiently large so that the ball is hit high enough in spite of the large height HG of the center of gravity. Although the loft angle is reduced in an iron longer in club length, the height HG of the center of gravity becomes low so that the launch angle becomes high enough to make it easy to hit a ball high. In addition, as the height HG of the center of gravity becomes lower, the spin applied to the ball is reduced to increase a run after the ball falls. However, long irons are often used not to apply spin to a ball to thereby stop the ball on the green but to hit a ball out in an intended direction with a good orientation and roll the ball from short of the green to thereby make the ball on the green. It is therefore more important to increase the launch angle of a hit ball to thereby obtain an intended carry than to increase the spin.

According to the invention, the height HGR of the center of gravity of one club may be made equal to that of another club even if those clubs have different club numbers. Alternatively, the height HGR of the center of gravity may be increased as the club number increases. Even when the height HGR of the center of gravity is constant among the golf clubs different in club number, the height HG of the center of gravity can be made larger as the club number is larger. This is because the larger the club number of the club is, the larger the loft angle of the club is.

In order to apply spin to a ball more easily with an iron shorter in club length, it is preferable to make a design such that the thickness (back bottom thickness) T of the intersecting portion of the back portion and the sole portion is thinner in an iron shorter in club length. The thinner the back bottom thickness T is, the higher the height HG of the center of gravity is, and the shallower the depth ZG of the center of gravity is. In this embodiment, the intersecting portion is defined as a point E where the sole width S is maximal, and the thickness T of the intersecting portion is defined as a shortest distance between the point E and the inner surface of the hollow portion 30. The point E is defined as a point at the rear end of the head where a plane parallel to the face surface first comes in contact with the back portion when the parallel plane is made to approach the back portion from behind. The sole width S is a distance between the parallel plane including the point E and the face surface.

In order to apply spin to a ball easily, it is also preferable that the depth ZG of the center of gravity is made shallower in an iron shorter in club length. According to the invention, it is preferable that the depth ZG of the center of gravity is 4.3–7 mm, particularly 4.5–6.5 mm.

According to the invention, it is preferable that the thicknesses are changed whenever the club number is increased by one. However, for example, the thicknesses may be set as follows. That is, the thicknesses are fixed among a group of long irons (for example, #2, #3 and #4), the thicknesses are fixed among a group of middle irons (for example, #5, #6 and #7 or #5 and #6), and the thicknesses are fixed among a group of short irons (for example, #8 and #9 or #7, #8 and #9). Then, the thicknesses are changed among the long iron group, the middle iron group and the short iron group.

Although the thickness of the face portion is changed in the four stages of the first to fourth bottom surfaces in the embodiment, it may be changed in three stages or in five or more stages. From the point of view of easiness to produce, three to six stages are preferable. From the point of view of easiness to adjust the center of gravity, about four or five stages are preferable. Two stages are not enough to adjust the center of gravity.

It is preferable that the thickness of the first bottom surface in the upper portion of the face portion is about 1–2 mm. It is preferable that the thickness of the n-th bottom surface in the lowest portion is about 2.5–3.5 mm. It is preferable that the thickness of the n/2-th (or integer closest to n/2) bottom surface near the midpoint is about 1.5–3 mm. It is preferable that the sole width S is about 15–20 mm. It is preferable that the thickness B of the upper portion of the back portion is about 1–2 mm.

According to the invention, the thickness of the face portion may be changed gradually from the toe side to the heel side. For example, it can be considered that a long iron is designed so that the thickness is increased on the toe side while the thickness is reduced on the heel side; a middle iron is designed so that the face thickness is made substantially uniform between the toe side and the heel side; and a short iron is designed so that the thickness is reduced on the toe side while the thickness is increased on the heel side. Alternatively, the thickness may be changed in a contrary way. When the design of the center of gravity is made changing the thickness in the above mentioned manner, the easiness to turn over the head can be adjusted so that the design of club heads can be made for each swing type.

According to the invention, a similar change may be made on the thickness of the back portion from the toe side to the heel side.

According to the invention, a visco-elastic polymer, an adhesive material, a foamable resin, or a visco-elastic resin may be poured into the hollow portion 30 through the small hole 24. In addition, a chip may be fitted into the second recess portion 23 or a resin mold may be applied thereto so as to close the small hole 24 while an indication item such as a trade mark or a part number is formed in the second recess portion 23.

Metal forming the golf club head may have a specific gravity of about 6–9. Specific examples of such metals include steels such as soft iron, marageing steel and stainless steel, and copper alloys such as beryllium copper and bronze.

Incidentally, since the ribs 13, 14 and 15 are provided in the golf club head 1 according to this embodiment, the feeling of hitting a ball can be adjusted subtly. In order to make it possible to adjust the feeling of hitting a ball subtly, a thick portion 40 or 41 may be provided, in place of the ribs, in the central portion of the back surface of the face portion in the toe-heel direction as shown in FIGS. 8A and 8B or FIGS. 9A and 9B.

Figure 8A:
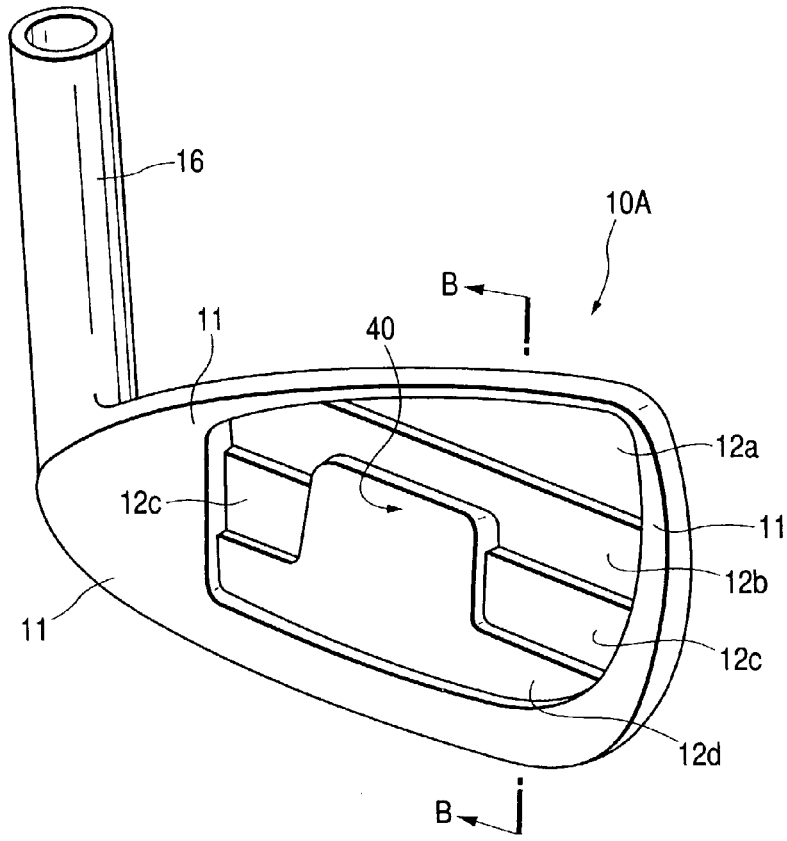
FIG. 8A is a perspective view from the rear of a face portion of a golf club head according to another embodiment of the invention.
Figure 8B:
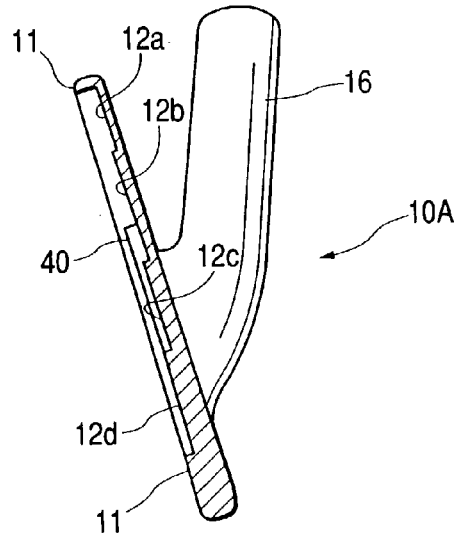
FIG. 8B is a sectional view taken on line B—B in FIG. 8A.

In a face portion 10A in FIGS. 8A and 8B, the thick portion 40 at the same level as the fourth bottom surface 12*d* crosses the third bottom surface 12*c* upward, and extends halfway up the second bottom surface 12*b*. The second and third bottom surfaces 12*b* and 12*c* on both sides of the thick portion 40 have the same structures as those in FIGS. 1–7.

According to the invention, the thick portion 40 may be provided to be thicker than that in FIGS. 8A and 8B, for example, to reach the first bottom surface 12*a*. On the contrary, the thick portion 40 may be provided to be thinner than that in FIGS. 8A and 8B, for example to be present only in the third bottom surface 12*c*. The thick portion 40 may be thicker than the illustrated one, for example, may be formed to rise from the fourth bottom surface 12*d*.

Figure 9A:
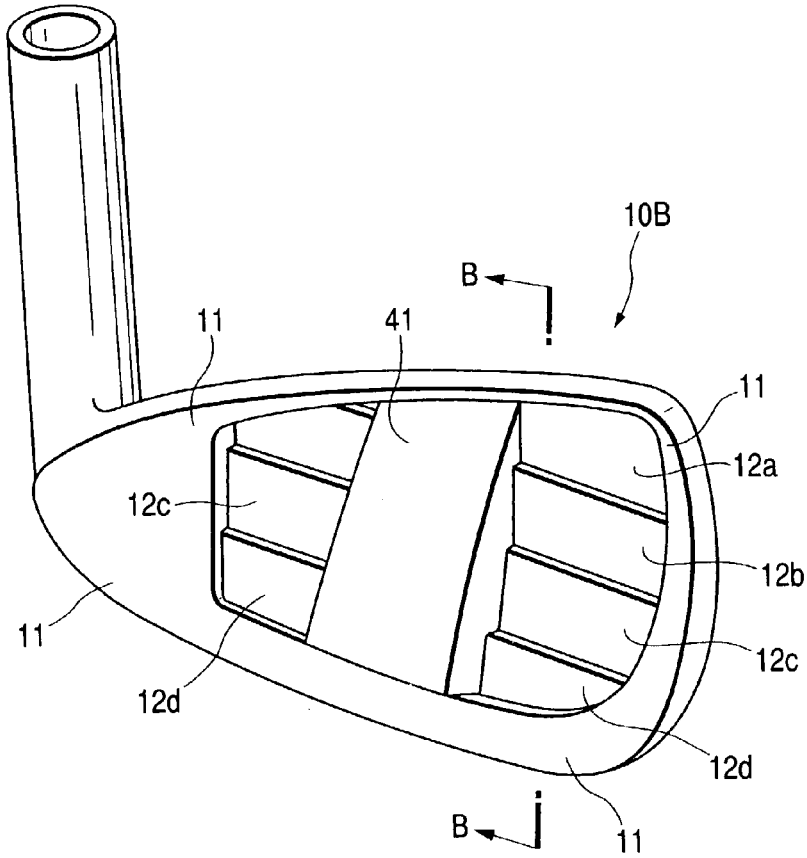
FIG. 9A is a perspective view from the rear of a face portion of a golf club head according to a further embodiment of the invention.
Figure 9B:
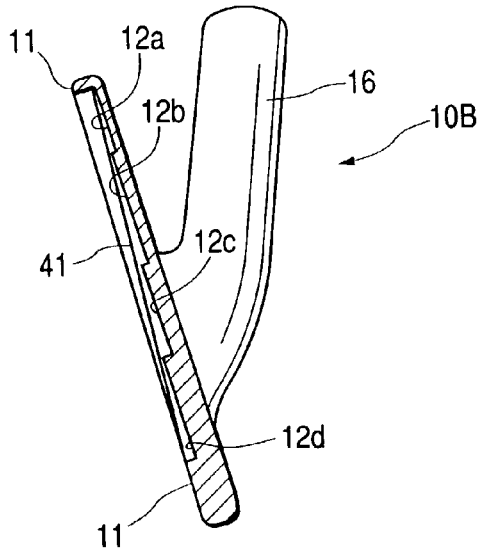
FIG. 9B is a sectional view taken on line B—B in FIG. 9A.

In a face portion 10B in FIGS. 9A and 9B, the thick portion 41 is provided continuously between the upper end of the recess portion 12 and the lower end thereof. The thickness of the face portion 10B in the thick portion 41 becomes thicker in its lower portion as shown in FIG. 9B. The back surface of the thick portion 41 becomes a slope inclined to the bottom surfaces 12*a* to 12*d* of the recess portion 12.

The other configurations of the face portions 10A and 10B in FIGS. 8A and 8B and FIGS. 9A and 9B are the same as the face portion 10 described previously. Each of the face portions 10A and 10B is also welded with the back portion so as to form a golf club head.

When such a thick portion 40 or 41 is provided, a response can be felted particularly by a senior golfer as if a ball hit by the golfer were crushed.

EXAMPLE

Description will be made below on an example of the invention and a comparative example. A golf club head, as shown in FIGS. 1–7, was made of stainless steel whose specific gravity was 7.8. The face portion and the back portion were formed separately from each other by casting in a lost-wax process, and they were welded integrally with each other. The ribs 13, 14 and 15 on the back surface of the face surface were set at 4.2 mm in thickness and 2.2 mm in width. The interval between the ribs was set at 11 mm. The thicknesses a, b, c and d of the face surface, the top thickness t and the back bottom thickness T are shown in Table 1. The depth ZG of the center of gravity, the heights HGR and HG of the center of gravity and the sole width S of each golf club head are shown together in Table 1.

As a comparative example, a golf club set was made up in the same manner as that in Example 1, except that the recess portion 12 was set to have a uniform depth (face thickness 3.5 mm), and no rib was provided.

TABLE 1

| | Example | | | | Comparative Example | | | |
|---|---|---|---|---|---|---|---|---|
| Number | #3 | #5 | #7 | #9 | #3 | #5 | #7 | #9 |
| loft angle | 20.5° | 26° | 34° | 42° | 20.5° | 26° | 34° | 42° |
| face thickness a | 1.5 | 1.6 | 1.8 | 2.2 | 3.5 | 3.5 | 3.5 | 3.5 |
| face thickness b | 1.8 | 2.0 | 2.2 | 2.4 | 3.5 | 3.5 | 3.5 | 3.5 |
| face thickness c | 2.6 | 2.6 | 2.6 | 2.7 | 3.5 | 3.5 | 3.5 | 3.5 |
| face thickness d | 3.4 | 3.2 | 3.2 | 3.2 | 3.5 | 3.5 | 3.5 | 3.5 |
| top thickness t | 1.5 | 1.6 | 1.6 | 2.2 | 3.5 | 3.5 | 3.5 | 3.5 |
| back bottom thickness T | 10.5 | 9.5 | 8.5 | 5.5 | 7 | 8.5 | 8.5 | 10 |
| depth (Zg) of center of gravity | 6.2 | 5.4 | 5 | 4.7 | 4.1 | 3.9 | 3.5 | 3.0 |
| height (Hgr) of center of gravity | 16.4 | 17.2 | 17.4 | 17.7 | 18.8 | 18.4 | 18.0 | 17.8 |
| height (Hg) of center of gravity | 18.6 | 19.7 | 20.4 | 21.1 | 20.3 | 20.2 | 20.1 | 20.0 |
| maximum sole width | 18.7 | 18.7 | 18 | 18 | 19.6 | 9.3 | 19.8 | 19.2 |

(unit other than loft angle: mm)

Practical shots were hit with the golf clubs, and evaluation was performed thereon.

First, in the evaluation with the #3 iron, it was easier to hit a ball high with the club according to the invention than with the club in the comparative example. In addition, the feeling of hitting the ball with the club according to the invention was steadier than with the club in the comparative example. Further, the #9 iron according to the invention was evaluated to be preferred to that according to the comparative example because the quantity of back spin was more so that the ball was stopped easily on the green. In addition, each iron head according to the invention had a usual iron head shape in appearance. Accordingly, each of the irons according to the invention was evaluated as "there is no uncomfortable feeling with the club at the ready.", "the club head is preferably easy to handle because it is not as large as a utility club head.", and "as the set, each club shows a function corresponding to its own club number preferably while having a usual iron shape."

As described above, according to the invention, a golf club head easy to hit a ball high and a golf club set provided with such golf club heads are provided. According to the invention, design can be made so that the launch angle is high enough to hit a ball high with a middle iron or a long iron while the spin is great enough to stop a ball easily with a short iron.

What is claimed is:

1. An iron-type hollow golf club head comprising:

a face portion;

a back portion; and a sole portion;

wherein the face portion, the back portion, and the sole portion define a hollow portion, wherein the face portion is thicker as approaching to a lower portion thereof at least on a toe side thereof so as to form a plurality of step-like portions, and wherein at least one rib is provided that extends from a top edge portion of the face portion to a bottom edge portion of the face portion.

2. The golf club head according to claim 1, wherein the plurality of step-like portions extend in a width direction of the face portion and are provided on a back surface of the face portion facing the hollow portion so that the face portion is thicker stepwise as approaching to the lower portion thereof.

3. The golf club head according to claim 1, wherein the at least one rib extends vertically near a central portion of a back surface of the face portion in a width direction of the face portion.

4. The golf club head according to claim 1, wherein the rib is provided near a central portion of a back surface of the face portion in a width direction of the face portion so that the rib is thicker than the face portion on a toe side.

5. The golf club head according to claim 1, wherein a loft angle is not larger than 43°.

6. The golf club head according to claim 1, wherein the thickness of the face portion increases from the top edge portion of the face portion to the bottom edge portion of the face portion.

7. The golf club head according to claim 1, wherein at least two columns of step-like portions are provided which are disposed parallel to each other.

8. The golf club head according to claim 7, wherein the at least one rib separates the two columns of step-like portions.

9. The golf club head according to claim 1, wherein the step-like portions are formed in a recessed area of the face portion.

10. The golf club head according to claim 1, wherein a plurality of columns of step-like portions are provided which extend from an upper portion to a lower portion of a back surface of the face portion.

11. An iron-type hollow golf club head comprising:

a face portion;

a back portion; and a sole portion;

wherein the face portion, the back portion, and the sole portion define a hollow portion, wherein the face portion is thicker as approaching to a lower portion thereof at least on a toe side thereof so as to form a plurality of step-like portions, and wherein a rib extending vertically is provided near a central portion of a back surface of the face portion in a width direction of the face portion.

12. The golf club head according to claim 11, wherein the plurality of step-like portions extend in a width direction of the face portion and are provided on a back surface of the face portion facing the hollow portion so that the face portion is thicker stepwise as approaching to the lower portion thereof.

13. The golf club head according to claim 11, wherein the rib is provided near a central portion of a back surface of the face portion in a width direction of the face portion so that the rib is thicker than the face portion on a toe side.

14. The golf club head according to claim 11, wherein a loft angle is not larger than 43°.

15. The golf club head according to claim 11, wherein the thickness of the face portion increases from a top edge portion of the face portion to a bottom edge portion of the face portion.

16. The golf club head according to claim 15, wherein the rib is provided to extend from the top edge portion to the bottom edge portion.

17. The golf club head according to claim 16, wherein at least two columns of step-like portions are provided which are disposed parallel to each other.

18. The golf club head according to claim 17, wherein the rib separates the two columns of step-like portions.

19. The golf club head according to claim 11, wherein the step-like portions are formed in a recessed area of the face portion.

20. The golf club head according to claim 11, wherein a plurality of columns of step-like portions are provided which extend from an upper portion to a lower portion of a back surface of the face portion.

* * * * *